US005868921A

United States Patent [19]

Barre et al.

[11] Patent Number: 5,868,921

[45] Date of Patent: Feb. 9, 1999

[54] SINGLE STAGE, STACKED BED HYDROTREATING PROCESS UTILIZING A NOBLE METAL CATALYST IN THE UPSTREAM BED

[75] Inventors: Guy Barre, Couronne, France; Johannes Petrus Van Den Berg, The Hague, Netherlands; Pierre Grandvallet, Couronne, France

[73] Assignee: Shell Oil Company, Houston, Tex.

[21] Appl. No.: 903,680

[22] Filed: Jul. 31, 1997

[30] Foreign Application Priority Data

Aug. 1, 1996 [EP] European Pat. Off. ..... 96401718

[51] Int. Cl.[6] ..... C10G 45/04; C10G 45/44

[52] U.S. Cl. ..... 208/57; 208/97; 208/143; 208/210; 208/211; 208/212

[58] Field of Search ..... 208/57, 97, 143, 208/210, 211, 212

[56] References Cited

U.S. PATENT DOCUMENTS

| | | | |
|---|---|---|---|
| 2,770,578 | 11/1956 | Haensel . | |
| 3,494,859 | 2/1970 | Parker et al. | 208/210 |
| 3,580,837 | 5/1971 | Pollitzer | 208/57 |
| 3,788,976 | 1/1974 | Kirk, Jr. | 208/89 |
| 4,202,798 | 5/1980 | Johnson et al. | 208/217 |
| 4,776,945 | 10/1988 | Washecheck et al. | 208/89 |
| 4,913,797 | 4/1990 | Albinson et al. . | |

FOREIGN PATENT DOCUMENTS

| | | |
|---|---|---|
| 0 203 228 A1 | 12/1986 | European Pat. Off. . |
| 0 653 242 A1 | 5/1995 | European Pat. Off. . |
| 0 743 351 A2 | 5/1995 | European Pat. Off. . |
| 1191471 | 5/1970 | United Kingdom . |
| 96/03208 | 2/1996 | WIPO . |
| 97/05948 | 2/1997 | WIPO . |

OTHER PUBLICATIONS

International Search Report of 25 Nov. 1997.

*Primary Examiner*—Walter D. Griffin

[57] ABSTRACT

A hydrocarbon distillate fraction is hydrotreated in a single stage by passing the distillate fraction downwardly over a stacked bed of two hydrotreating catalysts. The catalyst in the upper bed contains 0.1 to 15% by weight of platinum and/or palladium and also contains 2 to 40% by weight of at least one of tungsten, chromium, a Group VIIB metal, and an actinium series metal supported on an acidic refractory oxide carrier. The catalyst in the lower bed contains 1 to 15% by weight of a non-noble Group VIII metal and 1 to 25% by weight of a Group VIB metal on an amorphous, refractory oxide carrier. The liquid hydrocarbon product recovered has a reduced content of aromatics and a reduced heteroatom content.

7 Claims, No Drawings

SINGLE STAGE, STACKED BED HYDROTREATING PROCESS UTILIZING A NOBLE METAL CATALYST IN THE UPSTREAM BED

FIELD OF THE INVENTION

The present invention relates to a single stage process for hydrotreating hydrocarbon distillate fractions using a stacked bed of dedicated hydrotreating catalysts.

The expression "hydrotreating" as used in this specification refers to hydrogenation, hydrodesulfurization and hydrodenitrogenation.

BACKGROUND OF THE INVENTION

Stacked bed hydrotreating processes are known in the art. For instance, in European Patent Application No. 0,203,228 a single stage hydrotreating process is disclosed, wherein certain hydrocarbon oils having a tendency to deactivate hydrotreating catalysts by coke formation are passed over a stacked bed of two hydrotreating catalysts in the presence of hydrogen. The stacked bed comprises an upper zone containing a hydrotreating catalyst comprising a Group VIB metal component, a (non-noble) Group VIII metal component and phosphorus supported on an inorganic oxide carrier and a lower zone containing a similar hydrotreating catalyst but with no or hardly any phosphorus.

In UK Patent Application No. 2,073,770 a process is disclosed for hydroprocessing heavy hydrocarbon feedstocks, wherein the feedstock is contacted with two hydroprocessing catalysts, suitably arranged in a stacked bed configuration, which catalysts have different pore size distributions. Each catalyst comprises a refractory ceramic oxide support and as hydrogenation component one or more components of Group VIB metals and (non-noble) Group VIII metals. Promoters, such as phosphorus and titanium oxide, may also be present. Suitable heavy feedstocks are those exemplified by deasphalted atmospheric and vacuum residues, vacuum gas oils and mixtures thereof. Suitably, the process is operated under hydrocracking conditions with the carrier of the upper zone catalyst (e.g. alumina) being less acidic than the lower zone catalyst (e.g. silica-alumina).

A stacked bed process is also disclosed in U.S. Pat. No. 4,913,797. In the process disclosed, a hydrocarbon feed containing waxy components and sulfur- and nitrogen-containing compounds is first subjected to hydrotreatment and subsequently to a dewaxing treatment. The catalyst used in the hydrotreatment stage is a conventional hydrotreating catalyst, while the catalyst used for dewaxing suitably comprises a noble metal supported on a zeolite beta carrier. Between both stages a purification treatment may be carried for removing sulfur and nitrogen compounds from the hydrotreated effluent. The process may be carried out in a stacked bed mode with a bed of the hydrotreating catalyst on top of a bed of the dewaxing catalyst.

Dedicated hydrocracking processes which may be carried out in a stacked bed mode are also well known in the art. Examples of such processes are disclosed in European Patent Applications Nos. 0,310,164; 0,310,165; 0,428,224 and 0,671,457 and in U.S. Pat. No. 5,112,472. The catalysts used in these hydrocracking processes all comprise at least one hydrogenation component of a Group VIB and/or Group VIII metal supported on various carriers. However, these processes do not normally involve the use of noble metal-based catalysts, while in all processes a substantial part of the hydrocarbons boiling above 370° C. is converted into lower boiling material.

Although many of the prior art hydrotreating processes employing a stacked bed configuration perform satisfactorily in terms of reducing the content of sulfur and nitrogen species present in the feed, there is still room for improvement and in particular in terms of reducing the content of aromatic species present in the feed. Particularly from an environmental viewpoint it is highly desired to reduce the content of aromatics as much as possible. Aromatic compounds reduction may furthermore also be desirable for reaching certain technical quality specifications, such as cetane number in the case of automotive gas oils and smoke point in the case of jet fuels. The present invention therefore aims to provide a process wherein hydrocarbon distillate fractions ranging from naphtha to gasoils are effectively hydrotreated in a single stage by employing a stacked bed configuration, thereby significantly reducing both the aromatics content and the content of sulfur and nitrogen species present in the feed without substantial hydrocracking occurring.

SUMMARY OF THE INVENTION

The present invention therefore relates to a process for hydrotreating a hydrocarbon distillate fraction in a single stage, which process comprises passing the hydrocarbon distillate fraction downwardly over a stacked bed of two hydrotreating catalysts in the presence of hydrogen, wherein the stacked bed comprises:

(a) an upper catalyst bed consisting of a hydrotreating catalyst comprising from 0.1 to 15% by weight of platinum and/or palladium and from 2 to 40% by weight of at least one metal selected from the group consisting of tungsten, chromium, a Group VIIB metal and a metal of the actinium series supported on an acidic refractory oxide carrier, said weight percentages indicating the amount of metal based on the total weight of carrier, and (b) a lower catalyst bed consisting of a hydrotreating catalyst comprising from 1 to 15% by weight of a non-noble Group VIII metal and from 1 to 25% by weight, of a Group VIB metal on an amorphous inorganic refractory oxide carrier, said weight percentages indicating the amount of metal based on the total weight of catalyst, and recovering a liquid hydrocarbon oil product having a reduced content of aromatics and a reduced heteroatom content.

DESCRIPTION OF THE PREFERRED EMBODIMENTS

The hydrocarbon distillate fraction to be used as a feed to the present process may be any distillate fraction ranging from naphtha to gasoil obtained by distillation or fractionation of a hydrocarbon stream. Such hydrocarbon stream may be a crude oil, but may also be a hydrocarbon stream obtained from a conversion operation, such as a cracking operation. Accordingly, suitable feedstocks include naphtha fractions, kerosene fractions and gasoil fractions, which fractions may be either obtained as a straight-run fraction from the atmospheric distillation of a crude oil or as the vacuum distillate fraction from the vacuum distillation of an atmospheric residue. Distillate fractions obtained by fractionation or distillation of a cracked effluent, particularly of a thermally cracked effluent, may also be used as feedstock to the process according to the present invention. An example of such a feedstock is a cracked gasoil. Mixtures of two or more fractions from different sources may also be applied. In general, the present process has been found useful for hydrotreating hydrocarbon distillate fractions having a 10% by weight boiling point (that is, the temperature below which 10% by weight of a hydrocarbon fraction has its boiling point) of at least 30° C., preferably at least 100° C., and a 90% by weight boiling point of at most 520° C. Even more preferred feedstocks are those hydrocarbon distillate fractions having a 10% by weight boiling point of at least 175° C. and a 90% by weight boiling point of at most 450° C. Straight run gasoils, light gasoils, cracked gasoils, light cycle oils and mixtures of two or more of these, accordingly, are examples of feedstocks most suitably applied.

The hydrotreating process according to the present invention is a single stage process involving the use of a stacked bed of two different hydrotreating catalysts. This implies that there is no intermediate purification treatment, such as a stripping step to remove any gaseous sulfur and nitrogen species formed, between both catalyst beds constituting the stacked bed. Consequently, the stream which leaves the first catalyst bed is directly and completely passed over the second catalyst bed. It will be understood that this is advantageous from a process efficiency viewpoint, but it also implies that the lower bed catalyst should be resistant towards the sulfur and nitrogen species formed in the upper bed, mainly hydrogen sulfide and ammonia, and should accordingly not be deactivated by those species. On the other hand, the upper bed catalyst should have a sufficiently high tolerance towards the organic sulfur and nitrogen present in the feed. It has been found that using a hydrotreating catalyst comprising platinum and/or palladium and at least one metal selected from tungsten, chromium and a metal of the actinium series supported on an acidic refractory oxide carrier as the upper bed catalyst and a hydrotreating catalyst comprising a non-noble Group VIII metal and a Group VIB metal on an amorphous inorganic refractory oxide carrier as the lower bed catalyst, can adequately meet the aforesaid requirements as to tolerance towards sulfur and nitrogen species.

The upper bed catalyst is a hydrotreating catalyst comprising from 0.1 to 15% by weight, preferably from 1 to 10% by weight, of platinum and/or palladium and from 2 to 40% by weight, preferably from 5 to 30% by weight, of at least one metal selected from tungsten, chromium, a Group VIIB metal and a metal of the actinium series supported on an acidic refractory oxide carrier, said weight percentages indicating the amount of metal based on the total weight of carrier. Several of these catalysts are known and have been described in European Patent Application No. 0,653,242; International Patent Application No. WO 96/03208 and in yet International Patent Application No. WO 97/05948. Suitable Group VIIB metals are manganese and rhenium, of which rhenium is preferred. The actinium series refers to those elements of the Periodic Table of Elements having an atomic number ranging from 89 (Actinium, Ac) to 103 (Lawrentium, Lr). These elements are also sometimes referred to as actinides. For the purpose of the present invention the enriched forms of the actinides, i.e. the radioactive isotopes, are not likely to be used in practice. Preferred catalysts are those comprising palladium as the noble metal and tungsten, chromium, rhenium or uranium as the second metal, while even more preferred catalysts are those comprising palladium and either rhenium or uranium.

The acidic refractory oxide carrier of the upper bed catalyst suitably comprises zeolites, alumina, amorphous silica-alumina, fluorinated alumina or mixtures of two or more of these. Suitable zeolites include aluminosilicates like ferrierite, ZSM-5, ZSM-23, SSZ-32, mordenite, zeolite beta and zeolites of the faujasite type, such as faujasite and the synthetic zeolite Y. A particularly preferred aluminosilicate zeolite is zeolite Y, which is usually used in a modified, i.e. dealuminated, form. A particularly useful modified zeolite Y is one having a unit cell size below 24.60 Å, preferably from 24.20 to 24.45 Å and even more preferably from 24.20 to 24.35 Å, and a $SiO_2/Al_2O_3$ molar ratio in the range of from 10 to 150, preferably from 15 to 110 and more preferably from 30 to 90. Such carriers are known in the art and examples are, for instance, described in U.S. Pat. Nos. 4,925,820 and 4,960,505, the teachings of which are incorporated herein by reference, and European Patent Applications No. 0,512,652. Modified zeolite Y having an increased alkali(ne) metal —usually sodium— content, such as described in European Patent Application No. 0,519,573, can also be suitably applied.

In addition to any of the aforementioned carrier materials, the carrier may also comprise a binder material. The use of binders in catalyst carriers is well known in the art and suitable binders, then, include inorganic oxides, such as silica, alumina, silica-alumina, boria, zirconia and titania, and clays. The use of silica and alumina is preferred for the purpose of the present invention, while the most preferred binder is alumina. If present, the binder content of the carrier may vary from 5 to 95% by weight based on total weight of carrier. In a preferred embodiment, the carrier comprises 10 to 60% by weight of binder. A binder content of from 10 to 40% by weight has been found particularly advantageous. For the purpose of the present invention it has, accordingly, been found particularly advantageous to use a refractory oxide carrier comprising a modified zeolite Y as described herein before with alumina as a binder.

The lower bed hydrotreating catalyst comprises from 1 to 15% by weight of a non-noble Group VIII metal and from 1 to 25% by weight, of a Group VIB metal on an amorphous inorganic refractory oxide carrier, said weight percentages indicating the amount of metal based on the total weight of catalyst. Conventional, commercially available hydrotreating catalysts may be used as the lower bed catalysts. Preferred lower bed hydrotreating catalysts comprise nickel (Ni) and/or cobalt (Co) as the Group VIII metal and molybdenum (Mo) and/or tungsten (W) as the Group VIB metal supported on an alumina carrier, which may comprise from 0 to 70% by weight of silica. The use of an alumina carrier, suitably gamma-alumina, which is essentially free of silica is, however, preferred. The lower bed catalyst may suitably further comprise phosphorus (P) as a promoter in an amount of from 0.1 to 5% by weight. Hence, specific examples of suitable lower bed catalysts include NiMo(P) /alumina, CoMo(P) /alumina and NiW/alumina.

The volume ratio of upper catalyst bed to lower catalyst bed may vary within wide limits and suitably ranges from 10:90 to 95:5, more suitably 20:80 to 90:10.

The catalytically active metals present on the upper and lower bed catalyst may be present in elemental form, as an oxide, as a sulfide or as a mixture of two or more of these forms. Since in general suitable methods for preparing hydrotreating catalysts involve a final step of calcination in air, the catalytically active metals will at least partially be present as oxides directly after their preparation. Normally such final calcination step will cause substantially all catalytically active metals to be converted into their oxides. In order to make the catalyst suitable for processing sulfur-containing feeds, at least part of the metal components —usually metal oxides— present on the catalyst should be converted into sulfides. This can be attained by presulfiding methods known in the art. Two main groups of presulfiding methods can be distinguished, namely the in situ sulfidation methods and the ex situ sulfidation methods. The in situ methods involve sulfidation of the catalyst after it has been loaded into the reactor, suitably by contacting the catalyst with a sulfur-containing feed at conditions less sever than normal operating conditions. In situ presulfidation can be carried out at a temperature which is gradually increased from ambient temperature to a temperature of between 150° and 250° C. The catalyst is to be maintained at this temperature for between 10 and 20 hours. Subsequently, the temperature is to be raised gradually to the operating temperature for the actual hydroconversion process. In general, in situ presulfidation can take place, if the hydrocarbon feedstock has a sulfur content of at least 0.5% by weight, said weight percentage indicating the amount of elemental sulfur relative to the total amount of feedstock. It will be understood that in situ presulfidation of the catalyst may be advantageous for both process-efficiency and economic reasons. Ex situ presulfiding methods on the other hand involve sulfidation of the catalyst prior to it being loaded into a reactor, usually by contacting the catalyst with a suitable presulfiding agent. Suitable ex situ presulfiding methods are known in the art, such as for instance from U.S. Pat. Nos. 4,719,195; 4,983,558; 5,239,983; 5,397,756; 5,215,954; 5,292,702; and 5,468,372, the teachings of which are incorporated herein by reference, and International Patent Applications No. WO 94/25157. It is preferred in the process according to the present invention that the catalytically active metals are at least partly present in the catalyst as sulfides in both upper and lower bed catalyst. The degree of sulfidation of the metal oxides can be controlled by relevant parameters such as temperature and partial pressures of hydrogen, hydrogen sulfide, water and/or oxygen. Depending on the type of metals involved, the metal oxides may be completely converted into the corresponding sulfides, but there also may be formed an equilibrium state between the oxides and sulfides of the catalytically active metals. It will be appreciated that in the latter case the catalytically active metals are present both as oxides and as sulfides.

The hydrotreating catalysts can be prepared by the conventional methods known in the art. Commonly applied and well known methods involve impregnating the carrier with one or more solutions containing dissolved salts of the catalytically active metals followed by drying and calcining.

The operating conditions to be applied in the process according to the present invention are such that no substantial hydrocracking occurs, which means that the amount of material formed as a result of cracking and expressed in the weight percentage of material in the hydrotreated product having a boiling point below the initial boiling point of the feed, will be less than 15% by weight, more suitably less than 10% by weight and most suitably less than 6% by weight. Accordingly, the hydrotreating conditions suitably involve an operating temperature in the range of from 200° to 420° C., preferably from 210° to 380° C., and a total pressure in the range of from 10 to 200 bar, preferably from 25 to 100 bar. In addition, the weight hourly space velocity (WHSV) may range from 0.1 to 10 kg of oil per liter of catalyst per hour (kg/l.h), preferably from 0.5 to 5 kg/l.h, while the hydrogen to oil ratio is suitably in the range from 100 to 2,000 liters of hydrogen per liter of oil. These operating conditions in combination with the catalysts employed will result in a significant reduction in aromatics contents, in sulfur content and in nitrogen content, while at the same time the level of cracking that occurs is minimal.

The product stream leaving the lower catalyst bed comprises both liquid hydrocarbon product and a gaseous phase, which is rich in hydrogen but also contains gaseous sulfur and nitrogen species, such as hydrogen sulfide and ammonia formed during the hydrotreating reactions. Recovery of the liquid hydrocarbon oil product having a reduced content of aromatics and a reduced heteroatom content is, consequently, suitably effected by removing the gaseous components from the product stream leaving the lower catalyst bed by known phase separation techniques, such as stripping. An example of a very suitable phase separation method is a four separator system as disclosed in European Patent Application No. 0,336,484. The liquid hydrocarbon product finally recovered has a significantly reduced content of aromatics as well as a strongly reduced heteroatom content. The gaseous fraction recovered may be treated to remove inter alia ammonia and hydrogen sulfide, for instance by scrubbing techniques, after which the cleaned hydrogen-rich gas can be totally or partly recycled to the reactor inlet. Well known scrubbing techniques are those wherein aqueous solutions of alkanolamines, such as monoethanolamine, di-ethanolamine, di-isopropanolamine or mixtures of any one of these with sulfolane, are used as absorbents.

The invention will now be further illustrated by the following examples without restricting the scope of the invention to these particular embodiments.

EXAMPLE 1

An acidic carrier consisting of 80% by weight dealuminated zeolite Y (unit cell size of 24.25 Å and silica/alumina molar ratio of 80) and 20% by weight of an alumina binder was used.

A sample of this carrier was impregnated with an aqueous uranyl nitrate ($UO_2(NO_3)_2.6H_2O$) solution to reach 20% by weight $U_3O_8$ (corresponding with 17.0% by weight of U; said weight percentages being based on the weight of the carrier). The partially prepared catalyst was then dried and calcined for 2 hours at 400° C., after which impregnation with an aqueous solution of $H_2PdCl_4$ took place to reach a PdO content of 5% by weight (corresponding with 4.3% by weight of Pd). Finally, the completed catalyst was dried and calcined for 2 hours at 350° C. in air. The catalyst is further referred to as PdU/Y.

A bed of 20 $cm^3$ NiMo/alumina catalyst (3.0% wt Ni, 13.0% wt Mo) admixed with 80 $cm^3$ of silicon carbide particles (SiC; diameter 0.21 mm) was placed in a reactor. On top of this catalyst bed a bed consisting of a mixture of 20 $cm^3$ of the above PdU/Y and 80 $cm^3$ of the same SiC particles was loaded. The stacked bed thus obtained was presulfided according to the method disclosed in EP-A-0, 181,254. This method involved impregnation with di-tertiary nonyl polysulfide diluted in n-heptane, followed by drying for 2 hours at 150° C. under nitrogen at atmospheric pressure. The catalysts were subsequently activated by bringing the reactor on a total pressure of 50 bar with the help of hydrogen at a gas rate of 500 Nl/kg. The temperature was raised from ambient temperature to 250° C. in 2 hours, followed by the introduction of feed and increase of the temperature from 250° to 310° C. at a rate of 10° C./hr. The temperature of 310° C. was maintained for 100 hours.

After the activation was completed, a feed having the characteristics as indicated in Table I (BP is boiling point, IBP and FBP refer to initial and final boiling point, respectively) was passed over the stacked bed. The feed was a blend of 75% by weight of a straight run gasoil and 25% by weight of a light cycle oil. Process conditions included a weight average bed temperature (WABT) for the upper catalyst bed of 350° C., a total pressure of 50 bar, a gas rate of 500 Nl/kg and a weight hourly space velocity (WHSV) of 1.0 kg/l.h. Sulfur specification of the product was set at 10 parts per million on a weight basis (ppmw).

TABLE I

Feedstocks Characteristics

| | | | |
|---|---|---|---|
| S (% wt) | 1.37 | BP Distribution (°C.) | |
| N (ppmw) | 228 | IBP | 150 |
| Aromatics (mmol/100 g) | | 10% wt | 229 |
| Mono | 77.3 | 50% wt | 287 |
| Di | 55.3 | 90% wt | 357 |
| Poly | 20.4 | FBP | 424 |

The lower bed WABT required to meet the sulfur specification, level of cracking expressed in % by weight of the material formed which has a boiling point below the IBP of the feed (i.e. 150° C.), nitrogen content (in ppmw) and conversions (in % by weight) of mono-, di- and polyaromatics (tri+) were determined. In determining the conversions of the various aromatics it is assumed that aromatics are hydrogenated through a sequential reaction pathway, i.e. it is assumed that the polyaromatics are converted into diaromatics, diaromatics into monoaromatics and monoaromatics into naphthenics. This is a valid assumption, since it is known that hydrogenation of an aromatic ring contained in a polynuclear structure generally becomes kinetically less favorable as the number of aromatics ring in a polynuclear structure decreases. The monoaromatics which are found in the product may hence come from three sources: (i) from the unconverted monoaromatics already present in the feed, (ii) from converted diaromatics which were originally present in the feed and (iii) from converted diaromatics which, in return, originate from converted polyaromatics present in the feed.

The results are indicated in Table II.

EXAMPLE 2

Three further catalysts were prepared in the same way as in Example 1 using the same carrier, except that in stead of the aqueous uranyl nitrate solution three other impregnating solutions were used comprising W-, Re- or Cr-ions, respectively. All three catalysts had the same Pd-content (4.3% by weight) as the PdU catalyst of Example 1. The catalysts prepared were:

PdW/Y: using aqueous ammonium metatungstate impregnating solution to reach 20 %wt $WO_3$ (corresponding with 15.9% wt of W), PdRe/Y: using aqueous perrhenic acid ($HReO_4$) impregnating solution to reach 20% wt $ReO_2$ (corresponding with 17.1% wt of Re), and PdCr/Y: using an aqueous chromium(III)nitrate($Cr(NO_3)_3 \cdot 9H_2O$) impregnating solution to reach 20% by weight $Cr_2O_3$ (corresponding with 13.7% by weight of Cr).

After each of the above three catalysts was arranged in a stacked bed with a bottom bed of NiMo/alumina catalyst in the same way as in Example 1, the test procedure as described in Example 1 was followed for each stacked bed using the feedstock having the characteristics as indicated in Table I.

The results are listed in Table II.

TABLE II

Process Conditions and Performance

| Stacked bed with | PdU/Y | PdW/Y | PdCr/Y | PdRe/y |
|---|---|---|---|---|
| S (ppmw) | 10 | 10 | 10 | 10 |
| $WABT_{lower\ bed}$ (°C.) | 364 | 367 | 367 | 362 |
| N (ppmw) | 0.8 | 3.4 | 1.8 | 0.6 |
| cracking (% wt 150° C.) | 3.5 | 5.0 | 3.5 | 3.5 |
| Aromatics conv. (%) | 52.3 | 27.4 | 31.4 | 52.1 |
| Mono | 95.9 | 90.6 | 93.1 | 95.8 |
| Di | 95.1 | 88.7 | 92.9 | 94.9 |
| Poly | | | | |

From Table II it can be seen that the stacked bed hydrotreating process according to the present invention has an excellent performance in terms of aromatics conversion, denitrogenation and desulfurization, while at the level of cracking which occurs is reduced to a minimum.

Between the various stacked beds, however, there are some differences in performance. It is clear that the most preferred stacked beds with PdU/Y or PdRe/Y as the upper bed show the best results: the WABT required for reaching 10 ppmw sulfur specification is lower than for the stacked beds with PdW/Y or PdCr/Y as the upper bed, while denitrogenation activity and monoaromatics conversion are also higher. Still, the stacked beds comprising the PdW/Y and the PdCr/Y exhibit a very good overall performance.

What is claimed is:

1. Process for hydrotreating a hydrocarbon distillate fraction in a single stage, which process comprises passing the hydrocarbon distillate fraction downwardly over a stacked bed of two hydrotreating catalysts in the presence of hydrogen, wherein the stacked bed comprises (a) an upper catalyst bed consisting of a hydrotreating catalyst comprising from 0.1 to 15% by weight of platinum and/or palladium and from 2 to 40% by weight of a metal of the actinium series supported on an acidic refractory oxide carrier, said weight percentages indicating the amount of metal based on the total weight of carrier, and (b) a lower catalyst bed consisting of a hydrotreating catalyst comprising from 1 to 15% by weight of a non-noble Group VIII metal and from 1 to 25% by weight, of a Group VIB metal on an amorphous inorganic refractory oxide carrier, said weight percentages indicating the amount of metal based on the total weight of catalyst, and recovering a liquid hydrocarbon oil product having a reduced content of aromatics and a reduced heteroatom content.

2. The process according to claim 1, wherein the hydrocarbon distillate fraction has a 10% by weight boiling point of at least 100° C. and a 90% by weight boiling point of at most 520° C.

3. The process according to claim 1, wherein the upper bed hydrotreating catalyst comprises palladium and uranium.

4. The process according to claim 1, wherein the acidic refractory oxide carrier of the upper bed catalyst is selected from the group consisting of zeolites, alumina, amorphous silica-alumina, fluorinated alumina, and mixtures thereof.

5. Process according to claim 4, wherein the acidic refractory oxide carrier comprises modified, dealuminated zeolite Y with alumina as a binder.

6. The process according to claim 1, wherein the lower bed hydrotreating catalyst comprises nickel and/or cobalt as the Group VIII metal and molybdenum and/or tungsten as the Group VIB metal supported on an alumina carrier.

7. The process according to claim 6, wherein the lower bed catalyst further comprises from 0.1 to 5% by weight of phosphorus.

* * * * *